United States Patent [19]

Wolf

[11] Patent Number: 4,612,761

[45] Date of Patent: Sep. 23, 1986

[54] DRIVE FOR SPINNING OR TWISTING MACHINE

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 762,156

[22] Filed: Aug. 2, 1985

[30] Foreign Application Priority Data

Sep. 19, 1984 [DE] Fed. Rep. of Germany ..... 3434311

[51] Int. Cl.[4] ..... D01H 1/241; F16H 7/02; F16H 55/32

[52] U.S. Cl. ..... 57/105; 57/92; 474/153; 474/167; 474/177; 474/237

[58] Field of Search ..... 57/92, 104, 105; 474/131, 139, 143, 153, 159, 160, 162, 167, 168, 174, 175, 176, 177, 197, 200–204, 237, 240, 246–250

[56] References Cited

U.S. PATENT DOCUMENTS

| | | | |
|---|---|---|---|
| 1,635,363 | 7/1927 | Handley | 474/249 |
| 1,868,435 | 7/1932 | Thomas | 57/105 X |
| 1,915,571 | 6/1933 | Gardere | 474/247 |
| 2,718,747 | 9/1955 | Honig | 57/104 X |
| 3,333,408 | 8/1967 | Keyser | 57/104 |
| 3,544,403 | 12/1970 | Zenere | 57/104 X |
| 4,090,348 | 5/1978 | DiVittorio | 57/105 |

*Primary Examiner*—Donald Watkins
*Attorney, Agent, or Firm*—Karl F. Ross; Herbert Dubno

[57] ABSTRACT

A drive system drives a plurality of whorls rotatable about respective whorl axes and having radially outwardly directed faces centered on the respective axes, forming a discontinuous whorl surface, and of a predetermined whorl width measured parallel to the respective axes. The system has an endless flat drive belt extending past the whorls generally perpendicular to their axes and having a first belt surface radially directly confronting the whorl surface and of a predetermined axial belt width measured parallel to the axes and pusher rollers bearing radially inward against the belt and urging the belt surface toward the whorl surface. A ridge is formed on one of the surfaces, radially engages the other surface, holds the rest of the other surface out of contact with the one surface except at the ridge, and is of a predetermined ridge width in contact with the other surface and measured parallel to the axes equal to at most one-third of the belt width.

11 Claims, 10 Drawing Figures

DRIVE FOR SPINNING OR TWISTING MACHINE

FIELD OF THE INVENTION

The present invention relates to a drive for a yarn-spinning or -twisting machine. More particularly this invention concerns such a machine where a single flat belt tangentially engages and drives a plurality of flat drive pulleys or whorls.

BACKGROUND OF THE INVENTION

A twisting machine or a spinning machine of the standard or open-end type normally has a battery of identical spinning or twisting stations responsible for respective filaments and having respective cylindrical drive whorls all engaged tangentially by a flat belt that moves continuously. Pusher rollers tangentially oppositely engage the belt and thus press the belt with enough force against the whorls to rotate these whorls by engagement with the belt. Since the individual spinning or twisting units must be stopped and reloaded regularly such a drive is used, as the belt can be easily pushed off a single whorl by a simply actuatable roller to uncouple the respective unit from the belt.

The belt therefore must therefore be designed with two characteristics in mind: strength to transmit the considerable energy it must transfer from the main drive roll it passes over to the individual whorls and flexibility to pass around and over all the whorls and rollers without damage. The belt's strength is effectively limited by its cross-sectional size, since whatever the material used to reinforce the belt, the cumulative strength is equal to the amount used. On the other hand the belt's flexibility is largely determined by its thickness, since no matter what the material flexibility is inversely related to thickness. The obvious solution is therefore to make the belt fairly wide and relatively thin, maximizing strength while minimizing stiffness.

As a result the system generates a considerable amount of noise as the considerable surface of this belt continuously engages and disengages a plurality of rollers and whorls. The noise is so great in a large such machine that the workers changing the yarn packages must be protected from it.

OBJECTS OF THE INVENTION

It is therefore an object of the present invention to provide an improved drive system for a spinning or twisting machine.

Another object is the provision of such a drive system for a spinning or twisting machine or the like which overcomes the above-given disadvantages, that is which is fairly quiet.

SUMMARY OF THE INVENTION

A drive system according to this invention drives a plurality of whorls rotatable about respective whorl axes and having radially outwardly directed faces centered on the respective axes, forming a discontinuous whorl surface, and of a predetermined whorl width measured parallel to the respective axes. The system has an endless flat drive belt extending past the whorls generally perpendicular to their axes and having a first belt surface radially directly confronting the whorl surface and of a predetermined axial belt width measured parallel to the axes and pusher rollers bearing radially inward against the belt and urging the belt surface toward the whorl surface. In accordance with particular features of this invention a ridge is formed on one of the surfaces, radially engages the other surface, holds the rest of the other surface out of contact with the one surface except at the ridge, and is of a predetermined ridge width in contact with the other and measured parallel to the axes equal to at most one-third of the belt width.

The belt according to the invention has an opposite second belt face and the pusher rollers have roller faces radially engageable with the other belt surface, centered on respective roller rotation axes, forming a discontinuous roller surface, and of a predetermined roller width measured parallel to the respective axes and equal to at most one-third of the belt width.

The invention is based on the important discovery that even with only at most one third of the belt operatively engaging the whorl faces via the ridge, there is ample frictional contact to drive the spinning or twisting spindle connected to the whorls. Indeed in practice contact widths of 4 mm to 6 mm are sufficient. Similarly the reduced contact between the belt and the pusher rollers also is ample to keep the belt in good radial engagement with the whorls. Thus the out-of-contact portions of the belt serve primarily to allow it to be tensioned considerably.

In accordance with another feature of this invention the ridge is formed on the whorl surface. Another such ridge can also be formed on the roller surface, or the roller width itself can be equal to at most one-third of the belt width. It is also possible for the belt to be is formed on its first surface with the ridge and on its second surface with another such ridge.

The ridge according to the invention is of a material having a relatively great coefficient of friction on the whorl faces, achieved for instance by wetting the ridge or forming it of an elastomer with good frictional properties. Similarly, since there is no need to rotationally link the belt and the pusher rollers, the second surface of the belt has a relatively small coefficient of friction on the roller faces, achieved for instance by making it smooth and/or putting talcum powder or the like on it.

Furthermore according to this invention at least some of the pusher rollers are formed with radially outwardly open grooves at least of the roller width and receiving the belt. This is achieved when the grooved pusher rollers have flanges axially flanking the belt. Such structure is particularly useful with a belt that is operated on edge, to prevent it from sliding down on the whorls and rollers.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
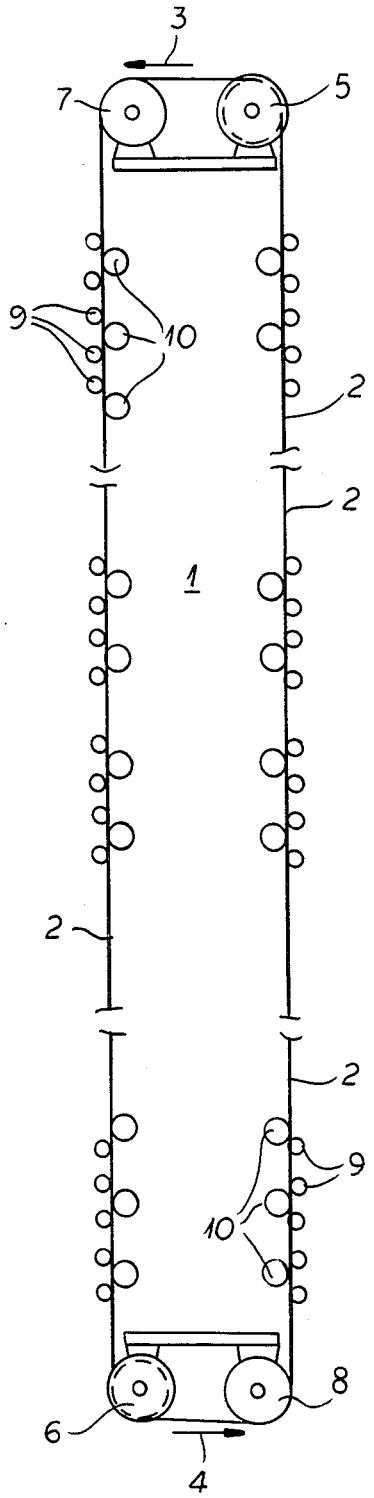
FIG. 1 is a small-scale top view of a drive system according to this invention.

As seen in FIG. 1 a drive 1 for a spinning or twisting machine has a continuous belt 2 that is pressed outward against a plurality of vertical whorls 9 by a plurality of inner vertical pressure rollers 10. At the ends of the drives are drive rolls 5 and 6 and deflector rollers 7 and 8 that move the belt 2 in the direction indicated by arrows 3 and 4. Of course only one such drive unit need be provided, two being used to halve the tension in the belt 2.

Figure 2:
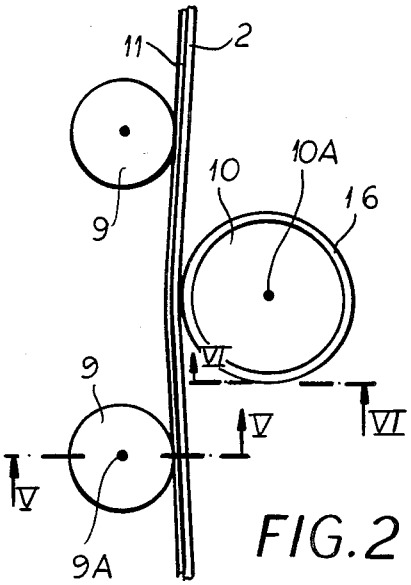
FIG. 2 is a large-scale view of a detail of FIG. 1.
Figure 5:
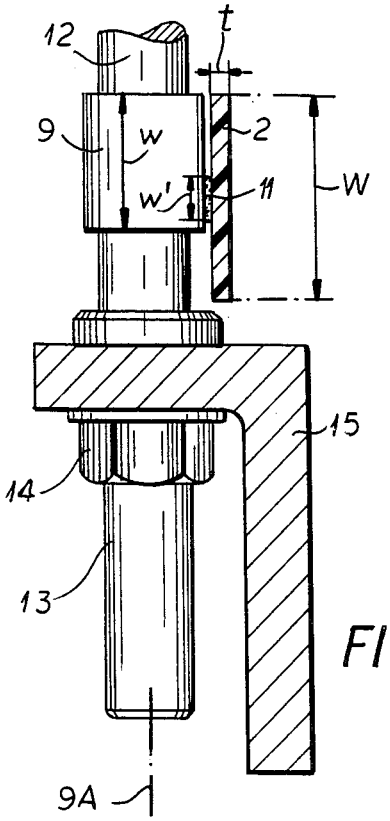
FIGS. 5 and 6 are sections taken respectively along lines V—V and VI—VI of FIG. 2.
Figure 6:
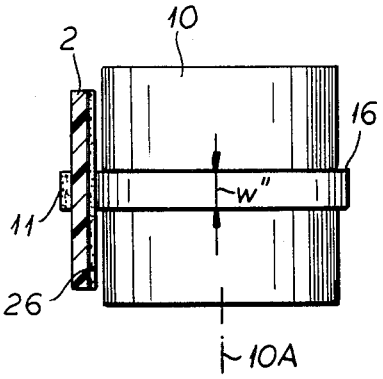

As better seen in FIGS. 2, 5, and 6, the belt 2 is of flat rectangular section, having a height or width W of 34 mm that is a large multiple, here ten times, its thickness t. The whorls 9 are cylindrical and carried on spindles 12 seated in bearings 13 secured by nuts 14 to a support 15 and each whorl 9 is centered on and rotatable about a horizontal axis 9A perpendicular to the belt 2 which engages it tangentially of this axis 9A. Each whorl 9 further has an overall axial height w that here is equal to about two-thirds the belt width W. Similarly, each roller 10 as shown in FIG. 6 is cylindrical and centered on a vertical axis 10A. These rollers 10 are axially longer than the belt 2.

According to this invention as best seen in FIG. 2 the belt 2 is provided centrally on its outside face turned toward the whorls 9 with a rectangular section ridge 11 having a width w' measured parallel to the axes 9A and 10A that is equal to at most W/3, here 6 mm. Thus on this side the belt 2 only engages the whorl 9 over a small portion of its width W and the amount of noise generated, and energy wasted generating noise, is reduced proportionately. This ridge 11 is of a material that has a relatively high coefficient of friction to engage the normally steel whorl 9 and rotate it, typically it can be of the elastomer such a laminated belt is normally made of.

As shown in FIG. 6 the cylindrical roller 10 is similarly formed with a radially outwardly projecting rectangular-section ridge 16 that has a width w'' measured parallel to the axes 9A and 10A that is equal to at most W/3, here 8 mm. Thus this side the belt 2 also only engages the whorl 9 over a small portion of its width W again reducing energy loss and noise generation. The inner face of the belt 2 is also provided with a slick or low-friction coating 26 for instance of polytetrafluoroethylene that reduces friction with the rollers 10, although obviously the integral ridge 11 on the opposite side is intended to frictionally engage the whorls 9.

Figure 3:
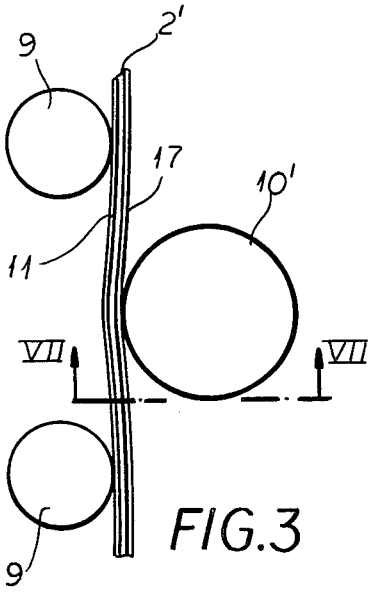
FIGS. 3 and 4 are views like FIG. 2 showing variations on the system of this invention.
Figure 7:
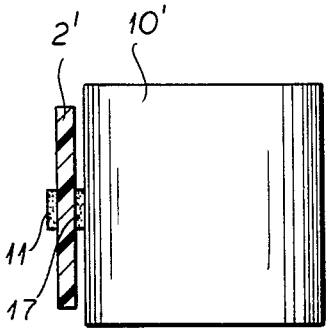
FIGS. 7 and 8 are sections taken respectively along lines VII—VII and VIII—VIII of FIGS. 3 and 4.

It is also possible as shown in FIGS. 3 and 7 to form another ridge 17 of the same dimensions as the ridge 11 on the inside face of a belt 2', and to use a wholly cylindrical roller 10' having no ridge 16. The effect here is similar, and the ridge 17 can be made of a low-friction material like the coating 26. The considerable angle through which the belt 2' engages its drive rolls shown at 5 and 6 in FIG. 1 ensures good coupling here under any circumstances. The drive wheels 5 and 6 for such a belt 2' would have a groove complementary to the ridge 17 so that they would engage the inner belt face above and below it, thereby maximizing contact area for maximum force transfer.

Figure 4:
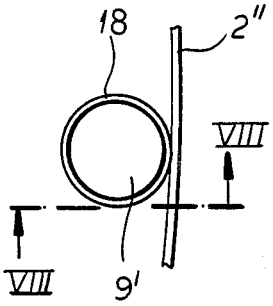
Figure 8:
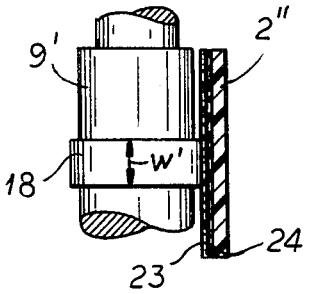

In FIGS. 4 and 8 a whorl 9' is formed with a ridge 18 of the width w' and the face of the belt 2'' engaging it is flat, with no ridge 11. This belt 8 is a laminate with an outer high-friction layer 23 engaging the whorl ridges 18 and an inner low-friction layer 24 engaging the unillustrated roller, which may be constructed like the roller 10 or 10'.

Figure 9:
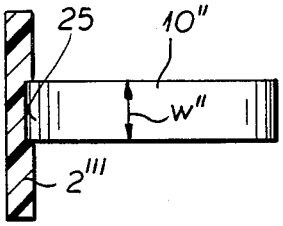
FIGS. 9 and 10 are views likes FIGS. 6, 7, and 8 of further variations on the system of this invention.

The system of FIG. 9 has a short pusher roller 10'' of the width w'', and the corresponding belt 2''' is formed with a rectangular groove 25 of identical width w'' that receives the edge of this roller 10''. This ensures good guiding and pushing of the belt 2''' while again minimizing noise.

Figure 10:
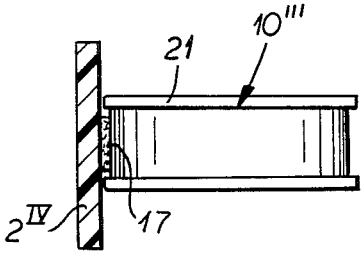

In FIG. 10 the belt $2^{iv}$ carries on its inside face the ridge 17 (FIGS. 3 and 7) but its outside face is unridged, intended to work with a whorl like the whorl 9' of FIG. 8. The respective pusher roller 10''' is only slightly wider than the width w' of the ridge 17 and has two end flanges 21 that flank and horizontally overlap the ridge 17. Once again these flanges 21 guide the belt $2^{iv}$. Such an arrangement is particularly useful with a belt which is used on edge, to prevent it from creeping down due to gravity.

I claim:

1. A drive system for a plurality of whorls rotatable about respective whorl axes and having radially outwardly directed faces centered on the respective axes, forming a discontinuous whorl surface, and of a predetermined whorl width measured parallel to the respective axes, the system comprising:

an endless flat drive belt extending past the whorls generally perpendicular to their axes and having a first belt surface radially directly confronting the whorl surface and of a predetermined axial belt width measured parallel to the axes;

pusher rollers bearing radially inward against the belt and urging the belt surface toward the whorl surface; and a ridge formed on one of the surfaces, radially engaging the other surface, holding the rest of the other surface out of contact with the one surface except at the ridge, and of a predetermined width measured parallel to the axes equal to at most one-third of the belt width, said belt having an opposite second belt face and the pusher rollers having roller faces radially engageable with the other belt surface, centered on respective roller rotation axes, forming a discontinuous roller surface, and being of a predetermined effective roller width measured parallel to the respective axes and equal to at most one-third of the belt width.

2. The flat-belt drive system defined in claim 1 wherein the ridge is formed on the whorl surface.

3. The flat-belt drive system defined in claim 1 wherein another such ridge is formed on the roller surface.

4. The flat-belt drive system defined in claim 1 wherein the roller width itself is equal to at most one-third of the belt width.

5. The flat-belt drive system defined in claim 1 wherein the belt is formed on its first surface with the ridge.

6. The flat-belt drive system defined in claim 1 wherein the belt is formed on its second surface with another such ridge normally engaging the roller surface.

7. The flat-belt drive system defined in claim 1 wherein the ridge has a relatively great coefficient of friction on the whorl faces.

8. The flat-belt drive system defined in claim 1 wherein the second surface of the belt has a relatively great coefficient of friction on the roller faces.

9. The flat-belt drive system defined in claim 1 wherein at least some of the pusher rollers are formed with radially outwardly open grooves at least of the roller width and receiving the belt.

10. The flat-belt drive system defined in claim 9 wherein the grooved pusher rollers have flanges axially flanking the belt.

11. A drive system for a plurality of whorls rotatable about respective whorl axes and having radially outwardly directed substantially cylindrical faces centered on the respective axes, forming a discontinuous whorl surface, and of a predetermined whorl width measured parallel to the respective axes, the system comprising:

an endless flat drive belt extending past the whorls generally perpendicular to their axes and having a first belt surface radially directly confronting the whorl surface and of a predetermined axial belt width measured parallel to the axes and a second belt surface;

pusher rollers having roller faces forming a discontinuous roller surface bearing radially inward against the second belt surface and urging the first belt surface toward the whorl surface;

a ridge formed on one of the first and whorl surfaces, radially engaging the other of the first and whorl surfaces, holding the rest of the other of the first and whorl surfaces surface out of contact with the one of the first and whorl surfaces surface except at the ridge, and of a predetermined width measured parallel to the axes equal to at most one-third of the belt width, and another ridge formed on one of the second and roller surfaces, radially engaging the other of the second and roller surfaces, holding the rest of the other of the second and roller surfaces surface out of contact with the one of the second and roller surfaces surface except at the ridge, and of a predetermined width measured parallel to the axes equal to at most one-third of the belt width.

* * * * *